US006986296B2

(12) United States Patent
Miyaji et al.

(10) Patent No.: US 6,986,296 B2
(45) Date of Patent: Jan. 17, 2006

(54) CAM APPARATUS

(75) Inventors: Takayuki Miyaji, Fujisawa (JP); Hideki Kiriaki, Fujisawa (JP)

(73) Assignee: Oiles Corporation, Tokyo (JP)

( * ) Notice: Subject to any disclaimer, the term of this patent is extended or adjusted under 35 U.S.C. 154(b) by 76 days.

(21) Appl. No.: 10/378,679

(22) Filed: Mar. 5, 2003

(65) Prior Publication Data

US 2003/0167874 A1 Sep. 11, 2003

(30) Foreign Application Priority Data

Mar. 7, 2002 (JP) ..... 2002-062063

(51) Int. Cl.
*B21D 5/04* (2006.01)

(52) U.S. Cl. ..... 74/567; 72/452.9

(58) Field of Classification Search ..... 74/110, 74/567; 72/452.8, 452.9; 100/266, 291
See application file for complete search history.

(56) References Cited

U.S. PATENT DOCUMENTS 5,269,167 A * 12/1993 Gerhart ..... 72/381
5,487,296 A * 1/1996 Gerhart et al. ..... 72/381
5,711,180 A 1/1998 Sasahara et al. ..... 72/381
5,881,599 A 3/1999 Sasahara et al. ..... 74/110
5,884,521 A 3/1999 Fidziukiewicz ..... 72/452.9
6,250,177 B1 * 6/2001 Sasahara ..... 74/567

FOREIGN PATENT DOCUMENTS

| | | | |
|---|---|---|---|
| DE | 197 53 549 A1 | | 6/1999 |
| JP | 04 138825 A | | 5/1992 |
| JP | 08019825 A | * | 1/1996 |
| JP | 09085498 A | * | 3/1997 |
| JP | 2000326024 A | * | 11/2000 |

* cited by examiner

*Primary Examiner*—Chong H. Kim
(74) *Attorney, Agent, or Firm*—Nixon & Vanderhye P.C.

(57) ABSTRACT

A cam apparatus includes: a cam driver; a cam slide adapted to move in contact with the cam driver and having a through hole; a cam-slide supporting device having a cam-slide supporting base which movably supports the cam slide, has a front wall portion disposed at a forward position in a moving direction of the cam slide, and has an opening in a backward position opposing the front wall portion in the moving direction of the cam slide; and a returning mechanism for returning the cam slide to an initial position thereof.

13 Claims, 4 Drawing Sheets

CAM APPARATUS

BACKGROUND OF THE INVENTION

1. Field of the Invention

The present invention relates to a cam apparatus for performing processing such as punching, bending, and the like with respect to a workpiece such as a thin plate by means of a tool fitted to a cam slide by causing the cam slide to slide by a cam driver.

2. Description of the Related Art

A cam apparatus of a suspended cam type, for example, generally comprises a cam driver which is adapted to be fixedly supported by a cam-driver supporting base; a cam slide having a sliding surface with a shape complementary to the sliding surface of the cam driver so as to movably contact that sliding surface; a cam-slide supporting base for movably suspending and supporting the cam slide so that the cam slide can move while being guided by the sliding surface of the cam driver as the sliding surface of the cam slide and the sliding surface of the cam driver are brought into contact with each other; and a returning mechanism having a coil spring for generating a returning force for returning the cam slide to its initial position.

In such a cam apparatus of the suspended cam type, at the time of performing the operation of adjusting and confirming the position of a tip of an edge tool in the state of a bottom dead center, the operation of removing the coil spring which generates a large returning force in the state of the bottom dead center is normally effected in advance so as to facilitate the operation of the position adjustment and confirmation.

Incidentally, the above-described operation of removing the coil spring involves the operation of dismounting and mounting the cam slide with respect to the cam-slide supporting base. Moreover, after the operation of the position adjustment and confirmation, the operation of dismounting and mounting the cam slide with respect to the cam-slide supporting base is required again to fit the coil spring.

In addition, the above-described troublesome operation is required also in the maintenance, inspection, and replacement of the coil spring in the cam apparatus which involves the operation of dismounting and mounting the cam slide with respect to the cam-slide supporting base for the operation of removing the coil spring in the operation of adjusting and confirming the position of the tip of the edge tool in the state of the bottom dead center.

It should be noted that such a drawback does not occur only in the cam apparatus of the suspended cam type, but similarly occurs in the cam apparatus of the lower mounted type as well.

SUMMARY OF THE INVENTION

The present invention has been devised in view of the above-described aspects, and its object is to provide a cam apparatus which makes it possible to speedily and easily effect the operation of adjusting and confirming the position of the tool tip and the operation of the maintenance, inspection, and replacement of the coil spring without performing troublesome operation such as the dismounting and mounting of the cam slide with respect to the cam-slide supporting base.

To this end, in accordance with a first aspect of the present invention, there is provided a cam apparatus comprising: a cam driver; a cam slide adapted to move in contact with the cam driver and having a through hole; cam-slide supporting means having a cam-slide supporting base which movably supports the cam slide, has a front wall portion disposed at a forward position in a moving direction of the cam slide, and has an opening in a backward position opposing the front wall portion in the moving direction of the cam slide; and a returning mechanism for returning the cam slide to an initial position thereof, the returning mechanism including a rod which is passed through the through hole of the cam slide, a rod supporting member which supports the rod slidably in the moving direction of the cam slide and is detachably fitted to the cam slide at one open end of the through hole of the cam slide located on an opening side of the cam-slide supporting base, and a coil spring disposed between the front wall portion and the rod supporting member in such a manner as to surround the rod, so as to resiliently urge the cam slide toward the opening of the cam-slide supporting base.

In the cam apparatus according to the above-described first aspect of the invention, since the rod supporting member is detachably fitted to the cam slide at one open end of the through hole of the cam slide, by removing the rod supporting member from the cam slide, it is possible to prevent the occurrence of the resiliency of the coil spring in the returning direction. Thus, it is possible to eliminate the occurrence of the returning force in the operation of adjusting and confirming the position of the tip of the edge tool.

In the present invention, it suffices if, as in the cam apparatus in accordance with a second aspect of the invention, the rod has a rod main body and a rod subsidiary body having one end portion threadedly secured to one end portion of the rod main body. In the case of such a rod, since the rod main body and the rod subsidiary body can be easily separated from each other, the coil spring can be easily removed and fitted with respect to the rod.

In addition, in the present invention, it suffices if, as in the cam apparatus in accordance with a third aspect of the invention, the rod has one enlarged-diameter end portion abutting against the front wall portion of the cam-slide supporting base and another enlarged-diameter end portion located on the opening side of the cam-slide supporting base. In the case of such a rod, it is possible to reliably prevent the rod from coming off the rod supporting member.

In addition, in the present invention, it suffices if, as in the cam apparatus in accordance with a fourth aspect of the invention, the coil spring abuts against, at one end thereof, the one enlarged-diameter portion and, at another end thereof, against one of the rod supporting member and an adjusting plate disposed between the coil spring and the rod supporting member. In the case of such a coil spring, if the returning mechanism is pulled out from the opening side of the cam-slide supporting base, the coil spring can also be pulled out reliably. Moreover, in a case where the adjusting plate is disposed between the rod supporting member and the other end of the coil spring, it is possible to optimally adjust the resiliency and, hence, the returning force of the coil spring by using the adjusting plate of an appropriate thickness.

In accordance with a fifth aspect of the present invention, in the cam apparatus according to any one of the above-described aspects, the cam slide has a recessed portion in an end face located on the opening side of the cam-slide supporting base, and the rod supporting member is detachably fitted to the cam slide in the recessed portion of the cam slide by means of a bolt.

In accordance with the cam apparatus according to the fifth aspect, it is possible to reduce or eliminate the projection of the rod supporting member from the end face of the cam slide. Accordingly, even if the rod supporting member is added, the length of the apparatus in the moving direction of the cam slide does not become long.

In accordance with a sixth aspect of the present invention, in the cam apparatus according to any one of the above-described aspects, the cam-slide supporting base includes both side wall portions arranged on both sides of the cam slide and a suspending and supporting mechanism for movably suspending and supporting the cam slide at the both side wall portions. Further, the cam-slide supporting means has a drop preventing mechanism for preventing the cam slide from dropping off the cam-slide supporting base, the drop preventing mechanism having drop preventing plates which are removably secured respectively to one of the front wall portion and the both side wall portions on a front wall portion side and to the both side wall portions on the opening side, so as to receive the end portions of the rod when the cam slide drops.

In accordance with the cam apparatus according to the sixth aspect, the drop preventing mechanism has the drop preventing plates which are removably secured respectively to one of the front wall portion and both side wall portions on the front wall portion side and to both side wall portions on the opening side so as to receive the respective end portions of the rod when the cam slide drops. Therefore, even if the suspending and supporting mechanism fails to function, it is possible to prevent an unintentional drop of the cam slide from the cam-slide supporting base, so that the apparatus is extremely fail-safe.

As in the cam apparatus in accordance with a seventh aspect, the drop preventing plates are removably secured respectively to one of a lower surface of the front wall portion and lower surfaces of the both side wall portions on the front wall portion side and to the lower surfaces of the both side wall portions on the opening side by means of bolts.

In accordance with the cam apparatus according to the seventh aspect, since the drop preventing plates are secured to the lower surfaces by means of the bolts, by loosening the bolts from below and by removing them, it is possible to remove the drop preventing plates simply, and the pulling-out operation of the returning mechanism can be effected with greater ease without difficulty.

In accordance with an eighth aspect of the present invention, in the cam apparatus according to the above-described sixth or seventh aspect, the cam slide includes a cam slide body and slide plates which are respectively fitted to both side surfaces of the cam slide body so as to be brought into sliding contact with the respective side wall portions of the cam-slide supporting base, the suspending and supporting mechanism has suspending members which are removably secured respectively to lower surfaces of the both side wall portions, and distal ends of the suspending members are disposed on lower surfaces of the slide plates of the cam slide, thereby movably suspending the cam slide.

In accordance with a ninth aspect of the present invention, in the cam apparatus according to any one of the above-described aspects, the cam driver is adapted to be fixedly supported by the cam-driver supporting base, the cam slide has a sliding surface with a shape complementary to a sliding surface of the cam driver so as to movably contact the sliding surface of the cam driver, and the cam-slide supporting base is adapted to movably suspend and support the cam slide so that the cam slide can move while being guided by the sliding surface of the cam driver as the sliding surface of the cam slide and the sliding surface of the cam driver are brought into contact with each other.

In accordance with a tenth aspect of the present invention, in the cam apparatus according to any one of the above-described aspects, the rod has a maximum diameter smaller than a diameter of the through hole, and the coil spring has a maximum diameter smaller than the diameter of the through hole.

In accordance with the cam apparatus according to the tenth aspect, the rod, which is passed through the through hole in the cam slide, has a maximum diameter smaller than the diameter of the through hole, and the coil spring, which is disposed between the front wall portion and the rod supporting member in such a manner as to surround the rod, has a maximum diameter smaller than the diameter of the through hole. Thus, the returning mechanism formed as a unit composed of the rod supporting member, the rod, and the coil spring can be pulled out from the opening side of the cam-slide supporting base. Consequently, it is possible to speedily and easily effect the operation of adjusting and confirming the position of the tool tip and the operation of the maintenance, inspection, and replacement of the coil spring without performing troublesome operation such as the dismounting and mounting of the cam slide with respect to the cam-slide supporting base.

In accordance with the present invention, it is possible to provide a cam apparatus which makes it possible to speedily and easily effect the operation of adjusting and confirming the position of the tool tip and the operation of the maintenance, inspection, and replacement of the coil spring without performing troublesome operation such as the dismounting and mounting of the cam slide with respect to the cam-slide supporting base.

Hereafter, a description will be given of the present invention with reference to the embodiment shown in the drawings. It should be noted that the present invention is not limited to the embodiment.

DESCRIPTION OF THE PREFERRED EMBODIMENT

Figure 1:
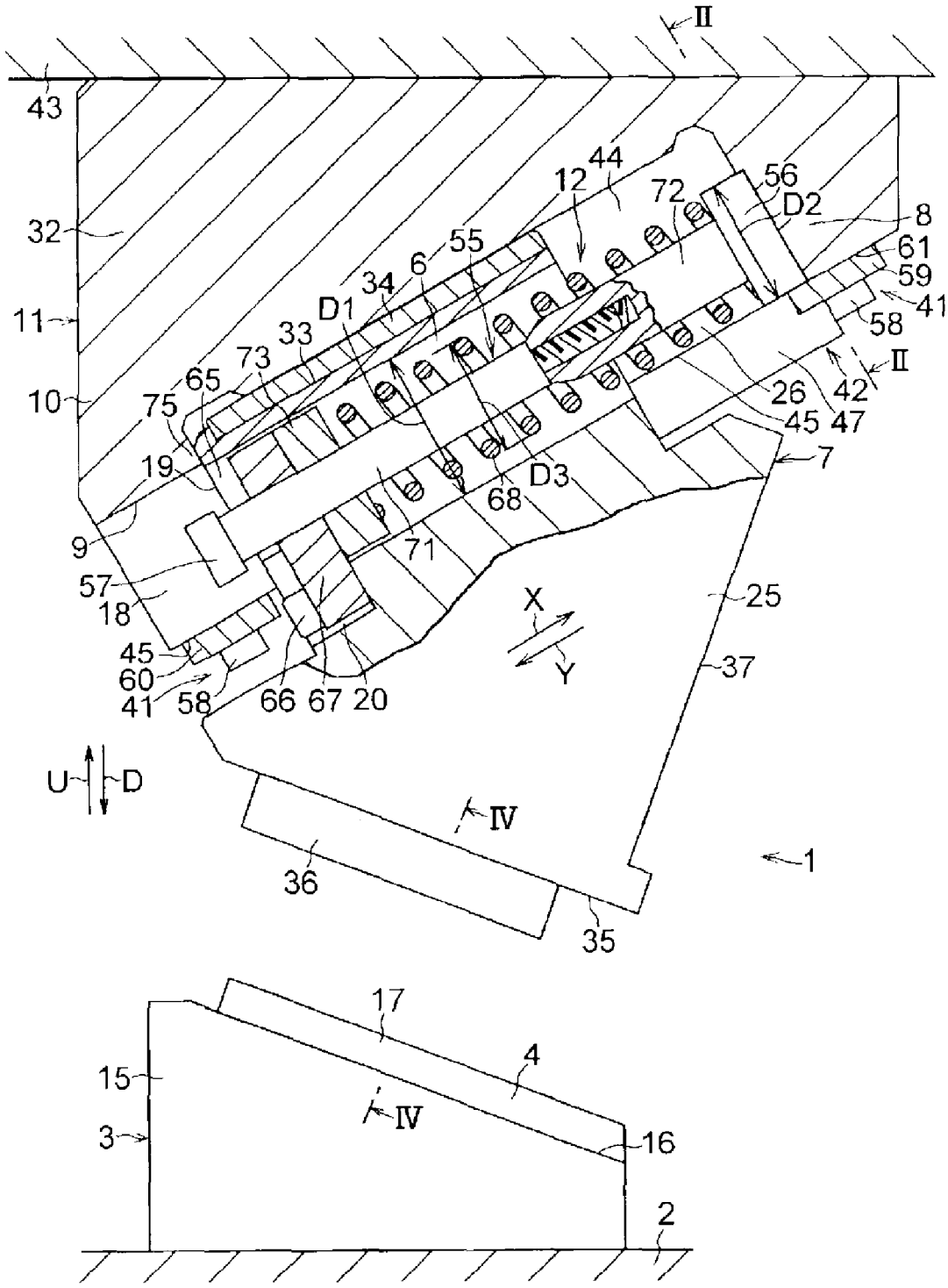
FIG. 1 is an explanatory diagram, partly in section, of a preferred embodiment of the present invention.
Figure 2:
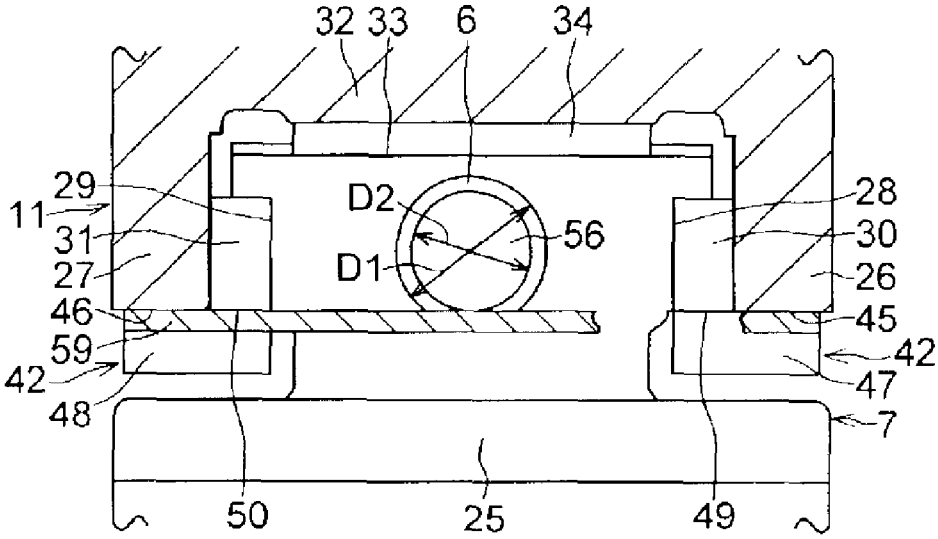
FIG. 2 is a cross-sectional view taken in the direction of arrows along line II—II of FIG. 1.
Figure 3:
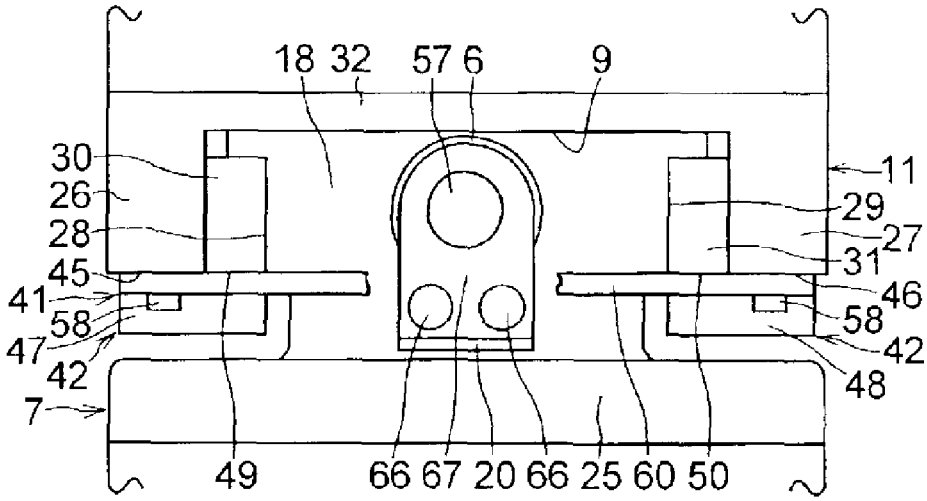
FIG. 3 is a left side elevational view of a portion shown in FIG. 1.
Figure 4:
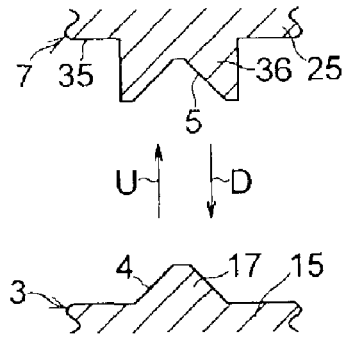
FIG. 4 is a cross-sectional view taken in the direction of arrows along line IV—IV of FIG. 1.

In FIGS. 1 to 4, a cam apparatus 1 of a suspended cam type of this embodiment comprises a cam driver 3 which is adapted to be fixedly supported by a cam-driver supporting base 2; a cam slide 7 having a sliding surface 5 with a shape complementary to a sliding surface 4 of the cam driver 3 and having a through hole 6, so as to movably contact the sliding surface 4; a cam-slide supporting means 11 having a cam-slide supporting base 10 for movably supporting the cam slide 7 in a direction X and a direction Y so that the cam slide 7 can move in the direction X while being guided by the sliding surface 4 of the cam driver 3 as the sliding surface 5 of the cam slide 7 and the sliding surface 4 of the cam driver 3 are brought into contact with each other, the cam-slide supporting base 10 having a front wall portion 8 disposed at a forward position as viewed in the moving direction X of the cam slide 7 and having an opening with a recessed portion 9 in a backward position opposing the front wall portion 8 as viewed in the moving direction X of the cam slide 7; and a returning mechanism 12 for returning the cam slide 7 to its initial position (position shown in FIG. 1).

The cam driver 3 includes a base body 15 fixed to the cam-driver supporting base 2 by means of bolts or the like and a projecting portion 17 formed integrally with an inclined upper surface 16 of the base body 15. The sliding surface 4 in this embodiment is formed in an inverse V-shape and is provided on the projecting portion 17.

The cam slide 7 has a recessed portion 20 in an end face 19 located on the side of an opening 18 defined by the recessed portion 9 of the cam-slide supporting base 10, and is adapted to move in contact with the cam driver 3. The cam slide 7 includes a cam slide body 25 in which the aforementioned through hole 6 and the recessed portion 20 communicating with the through hole 6 are respectively formed; slide plates 30 and 31 which are respectively fitted to side surfaces 28 and 29 of the cam slide body 25 by means of stud bolts or the like in such a manner as to come into sliding contact with side wall portions 26 and 27, respectively, of the cam-slide supporting base 10; a slide plate 34 fitted to an upper surface 33 of the cam slide body 25 by means of stud bolts or the like in such a manner as to come into sliding contact with a base portion 32 of the cam-slide supporting base 10; and a bifurcating projecting portion 36 formed integrally with an inclined lower surface 35 of the cam slide body 25. The sliding surface 5 in this embodiment is formed in an inverse V-shape and is provided on the projecting portion 36. A tool such as an edge tool is mounted on a front surface 37 of the cam slide body 25 by means of bolts or the like.

The cam-slide supporting means 11 has, in addition to the cam-slide supporting base 10, a drop preventing mechanism 41 for preventing the cam slide 7 from dropping off the cam-slide supporting base 10.

The cam-slide supporting base 10 includes the base portion 32; both side wall portions 26 and 27 arranged on both sides of the cam slide body 25 of the cam slide 7 and formed integrally on both sides of the base portion 32; the front wall portion 8 formed integrally with both side wall portions 26 and 27 and the base portion 32 in such a manner as to bridge both side wall portions 26 and 27; and a suspending and supporting mechanism 42 for movably suspending and supporting the cam slide 7 at both side wall portions 26 and 27. The base portion 32 is secured to a foundation bed 43, which is attached to a hydraulic ram or the like, by means of bolts or the like. A cavity 44 is defined by the front wall portion 8, both side wall portions 26 and 27, and the base portion 32. An upper portion of the cam slide body 25 is disposed in the cavity 44, which is open at the opening 18, in such a manner as to be movable in the X and Y directions.

The suspending and supporting mechanism 42 has a pair of plate-like suspending members 47 and 48 secured to lower surfaces 45 and 46 of respective both side wall portions 26 and 27 in such a manner as to be removable by stud bolts or the like. Distal ends of the suspending members 47 and 48 are disposed on lower surfaces 49 and 50 of the slide plates 30 and 31 of the cam slide 7, thereby suspending the cam slide 7 movably in the X and Y directions.

The cam-slide supporting base 10 is adapted to suspend and support the cam slide 7 movably in the X and Y directions by means of the suspending and supporting mechanism 42, such that the cam slide 7 can move in the X and Y directions while being guided by the sliding surface 4 of the cam driver 3 as the sliding surface 5 of the cam slide 7 and the sliding surface 4 of the cam driver 3 contact each other.

The drop preventing mechanism 41 has a pair of drop preventing plates 59 and 60 which are removably secured respectively to the front wall portion 8 or both side wall portions 26 and 27 on the front wall portion 8 side, i.e., to the front wall portion 8 in this embodiment, and to both side wall portions 26 and 27 on the opening 18 side by means of bolts 58, so as to receive enlarged-diameter end portions 56 and 57 at both ends of a rod 55 when the cam slide 7 drops unintentionally.

The drop preventing plate 59 is removably secured to a lower surface 61 of the front wall portion 8 by means of the bolts 58 on the front wall portion 8 side. Meanwhile, the drop preventing plate 60 is removably secured to the lower surfaces 45 and 46 of both side wall portions 26 and 27 by means of the bolts 58 on the opening 18 side in such a manner as to bridge the side wall portions 26 and 27.

Even if the bolts securing the suspending members 47 and 48 of the suspending and supporting mechanism 42 to the lower surfaces 45 and 46 of the side wall portions 26 and 27 are loosened, and the suspending members 47 and 48 drop off the lower surfaces 45 and 46 of the side wall portions 26 and 27, the drop preventing mechanism 41 is adapted to prevent the cam slide 7 from dropping off the cam-slide supporting base 10 by receiving the enlarged-diameter end portions 56 and 57 of the rod 55 from below by the drop preventing plates 59 and 60. Further, the drop preventing plates 59 and 60 are adapted to be removed from the front wall portion 8 and the side wall portions 26 and 27, respectively, by loosening and removing the bolts 58.

The returning mechanism 12 includes the rod 55 which is passed through the through hole 6 in the cam slide body 25 of the cam slide 7 and has a maximum diameter D2 smaller than a diameter D1 of the through hole 6; a rod supporting member 67 which supports the rod 55 slidably in the moving directions X and Y of the cam slide 7, and which is detachably fitted to the cam slide body 25 of the cam slide 7 by means of a pair of bolts 66 at an open end 65 of the through hole 6 in the cam slide body 25 located on the opening 18 side of the cam-slide supporting base 10; and a coil spring 68 which is disposed between the front wall portion 8 and the rod supporting member 67 in such a manner as to surround the rod 55, and has a maximum diameter D3 smaller than the diameter D1 of the through hole 6, so as to return the cam slide 7 to its initial position (position shown in FIG. 1) by resiliently urging the cam slide 7 toward the opening 18 of the cam-slide supporting base 10.

The rod 55 has the enlarged-diameter end portion 56 abutting against the front wall portion 8 of the cam-slide supporting base 10; the enlarged-diameter end portion 57 located on the opening 18 side of the cam-slide supporting base 10; a rod main body 71 having the enlarged-diameter end portion 57 provided integrally therewith; and a rod subsidiary body 72 which is threadedly secured at one end portion thereof to one end portion of the rod main body 71 and with which the enlarged-diameter end portion 56 is provided integrally.

The rod supporting member 67 is detachably fitted to the cam slide body 25 of the cam slide 7 by means of the bolts 66 in the recessed portion 20 of the cam slide body 25.

The coil spring 68 abuts against, at one end, the enlarged-diameter portion 56 and, at the other end, an annular adjusting plate 73 disposed between the coil spring 68 and the rod supporting member 67 and fitted over the rod main body 71. It should be noted that in a case where the enlarged-diameter portion 56 is not provided, the one end of the coil spring 68 may abut against the front wall portion 8. In addition, in a case where the adjusting plate 73 for adjusting the spring force of the coil spring 68 by its thickness is not provided, the other end of the coil spring 68 may abut against the rod supporting member 67.

Figure 5:
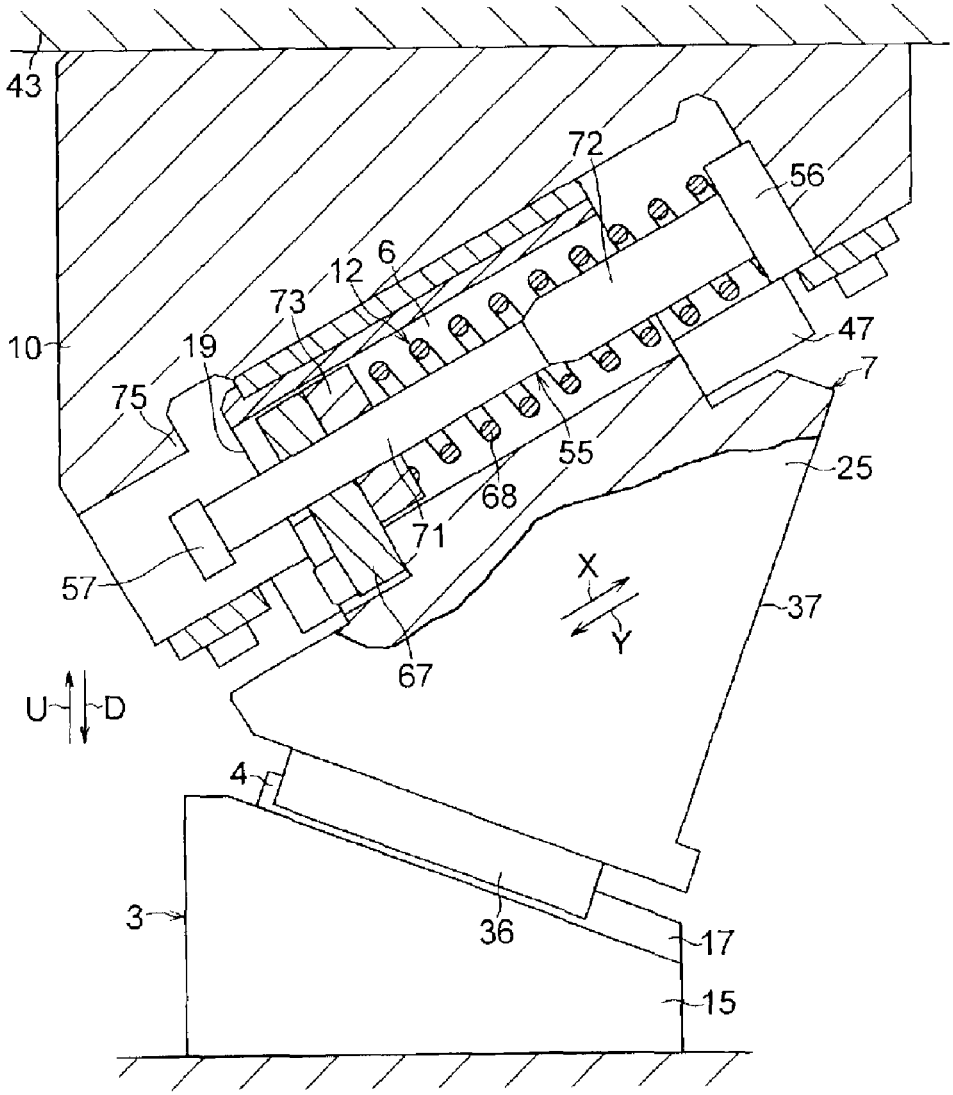
FIG. 5 is a diagram explaining the operation of the embodiment shown in FIG. 1.

The returning mechanism 12 operates as follows: As the foundation bed 43 and the cam-slide supporting base 10 are lowered in a D direction due to the operation of the hydraulic ram (not shown) connected to the foundation bed 43, the cam slide 7 is moved in the X direction by the cam driver 3, as shown in FIG. 5. Subsequently, as the cam-slide supporting base 10 together with the foundation bed 43 is raised in a U direction due to the reverse operation of the hydraulic ram, the returning mechanism 12 moves the cam slide 7 in the Y direction by means of the resiliency of the coil spring 68, thereby returning the cam slide 7 to its initial position in which the end face 19 of the cam slide body 25 abuts against a stepped portion 75 of the base portion 32, as shown in FIG. 1.

In the above-described cam apparatus 1, when the hydraulic ram is operated in the state in which the cam slide 7 has been returned to the initial position shown in FIG. 1, and the cam-slide supporting base 10 together with the foundation bed 43 is lowered in the D direction, the cam slide 7 is moved in the X direction due to the contact of its sliding surface 5 against the sliding surface 4 of the cam driver 3, as shown in FIG. 5. Then, a tool attached to the front surface 37 of the cam slide body 25 is adapted to effect bending, for example.

After the bending, in the cam apparatus 1, if the hydraulic ram is reversibly operated, and the cam-slide supporting base 10 together with the foundation bed 43 is raised in the U direction, the cam slide 7, in conjunction with the cancellation of the contact of its sliding surface 5 against the sliding surface 4 of the cam driver 3, is moved in the Y direction by the resiliency of the coil spring 68 of the returning mechanism 12, thereby returning to its initial position, as shown in FIG. 1.

Figure 6:
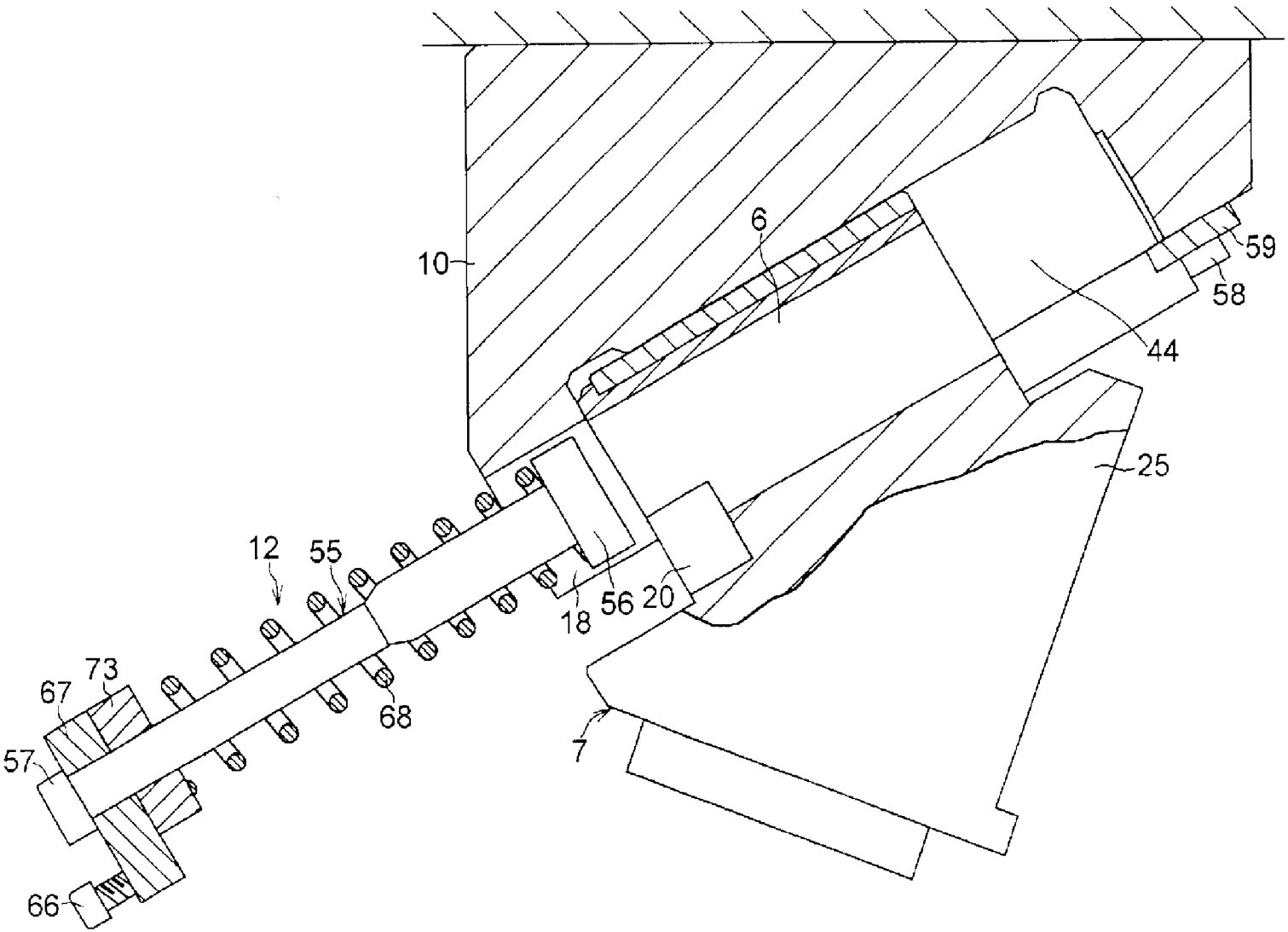
FIG. 6 is a diagram explaining the operation of the embodiment shown in FIG. 1.

As described above, the cam apparatus 1 is arranged such that the rod supporting member 67 is detachably fitted to the cam slide 7 at the open end 65 of the through hole 6 of the cam slide 7, and the rod 55 which is passed through the through hole 6 in the cam slide 7 has the maximum diameter D2 smaller than the diameter D1 of the through hole 6. Further, the coil spring 68, which is disposed between the front wall portion 8 and the rod supporting member 67 in such a manner as to surround the rod 55, has the maximum diameter D3 smaller than the diameter D1 of the through hole 6. Thus, after the drop preventing plate 60 is removed from each of the side wall portions 26 and 27 by loosening the bolts 58, the rod supporting member 67 can be removed from the cam slide body 25 of the cam slide 7 by loosening the bolts 66. As a result, it is, first of all, possible to prevent the occurrence of the resiliency of the coil spring 68 in the returning direction. Thus, it is possible to prevent the occurrence of the returning force in the operation of adjusting and confirming the position of the tool tip in the state of the bottom dead center shown in FIG. 5. Moreover, as shown in FIG. 6, the returning mechanism 12 formed as a unit composed of the rod supporting member 67, the rod 55, and the coil spring 68 can be pulled out from the opening 18 side of the cam-slide supporting base 10. Consequently, it is possible to speedily and easily effect the operation of adjusting and confirming the position of the tool tip and the operation of the maintenance, inspection, and replacement of the coil spring 68 without performing troublesome operation such as the dismounting and mounting of the cam slide 7 with respect to the cam-slide supporting base 10.

In addition, with the cam apparatus 1, since the rod 55 has the rod main body 71 and the rod subsidiary body 72 threadedly secured to the rod main body 71, the rod main body 71 and the rod subsidiary body 72 can be easily separated from each other, so that the coil spring 68 can be easily removed and fitted with respect to the rod 55. Furthermore, since the rod 55 has the enlarged-diameter end portions 56 and 57, it is possible to reliably prevent the rod 55 from unintentionally coming off the rod supporting member 67.

In addition, with the cam apparatus 1, since the coil spring 68 at its one end abuts against the enlarged-diameter end portion 56, if the returning mechanism 12 is pulled out from the opening 18 side of the cam-slide supporting base 10, the coil spring 68 can also be pulled out reliably. Moreover, since the adjusting plate 73 is disposed between the rod supporting member 67 and the other end of the coil spring 68, it is possible to optimally adjust the resiliency and, hence, the returning force of the coil spring 68 by using the adjusting plate 73 of an appropriate thickness. In addition, since the rod supporting member 67 is detachably fitted to the cam slide 7 at the recessed portion 20 by means of the bolts 66, it is possible to reduce or eliminate the projection of the rod supporting member 67 from the end face 19 of the cam slide 7. Accordingly, even if the rod supporting member 67 is added, the length of the apparatus in the moving direction of the cam slide 7 does not become long.

Furthermore, with the cam apparatus 1, the drop preventing mechanism 41 consists of the drop preventing plates 59 and 60 which are removably secured respectively to the front wall portion 8 and the side wall portions 26 and 27 so as to receive the enlarged-diameter end portions 56 and 57 at both ends of the rod 55 when the cam slide 7 drops, as described above. Therefore, even if the suspending and supporting mechanism 42 fails to function, it is possible to prevent an unintentional drop of the cam slide 7 from the cam-slide supporting base 10, so that the apparatus is extremely fail-safe. In addition, since the drop preventing plate 59 and the drop preventing plate 60 are removably secured to the lower surface 61 of the front wall portion 8 and to the lower surfaces 45 and 46 of both side wall portions 26 and 27, respectively, by means of the bolts 58, by loosening the bolts 58 from below and by removing them, it is possible to remove the drop preventing plates 59 and 60 simply. Also, since the drop preventing plate 60 can be removed simply, the pulling-out operation of the returning mechanism 12 can be effected with greater ease without difficulty.

What is claimed is:

1. A cam apparatus comprising:

a cam driver;

a cam slide adapted to move in contact with said cam driver and having a through hole;

cam-slide supporting means having a cam-slide supporting base which movably supports said cam slide, has a front wall portion disposed at a forward position in a moving direction of said cam slide, and has an opening in a backward position opposing said front wall portion in the moving direction of said cam slide; and a returning mechanism for returning said cam slide to an initial position thereof, said returning mechanism including a rod which is passed through the through hole of said cam slide, a rod supporting member which supports said rod slidably in the moving direction of said cam slide and is detachably fitted to said cam slide by means of a bolt at one open end of the through hole of said cam slide located on an opening side of said cam-slide supporting base, and a coil spring disposed between said front wall portion and said rod supporting member in such a manner as to surround said rod, so as to resiliently urge said cam slide toward said opening of said cam-slide supporting base.

2. The cam apparatus according to claim 1, wherein said rod has a rod main body and a rod subsidiary body having one end portion threadedly secured to one end portion of said rod main body.

3. The cam apparatus according to claim 1 or 2, wherein said rod has one enlarged-diameter end portion abutting against said front wall portion of said cam-slide supporting base and another enlarged-diameter end portion located on the opening side of said cam-slide supporting base.

4. The cam apparatus according to claim 3, wherein said coil spring abuts against, at one end thereof, said one enlarged-diameter portion and, at another end thereof, against one of said rod supporting member and an adjusting plate disposed between said coil spring and said rod supporting member.

5. The cam apparatus according to claim 1 or 2, wherein said cam slide has a recessed portion in an end face located on the opening side of said cam-slide supporting base, and said rod supporting member is detachably fitted to said cam slide in the recessed portion of said cam slide by means of said bolt.

6. The cam apparatus according to claim 1 or 2, wherein said cam-slide supporting base includes both side wall portions arranged on both sides of said cam slide and a suspending and supporting mechanism for movably suspending and supporting said cam slide at said both side wall portions, and wherein said cam-slide supporting means has a drop preventing mechanism for preventing said cam slide from dropping off said cam-slide supporting base, said drop preventing mechanism having drop preventing plates which are removably secured respectively to one of said front wall portion and said both side wall portions on a front wall portion side and to said both side wall portions on the opening side, so as to receive said end portions of said rod when said cam slide drops.

7. The cam apparatus according to claim 6, wherein said drop preventing plates are removably secured respectively to one of a lower surface of said front wall portion and lower surfaces of said both side wall portions on the front wall portion side and to the lower surfaces of said both side wall portions on the opening side by means of bolts.

8. The cam apparatus according to claim 6, wherein said cam slide includes a cam slide body and slide plates which are respectively fitted to both side surfaces of said cam slide body so as to be brought into sliding contact with said side wall portions of said cam-slide supporting base, said suspending and supporting mechanism has suspending members which are removably secured respectively to lower surfaces of said both side wall portions, and distal ends of said suspending members are disposed on lower surfaces of said slide plates of said cam slide, thereby movably suspending said cam slide.

9. The cam apparatus according to claim 1 or 2, wherein said cam driver is adapted to be fixedly supported by said cam-driver supporting base, said cam slide has a sliding surface with a shape complementary to a sliding surface of said cam driver so as to movably contact said sliding surface of said cam driver, and said cam-slide supporting base is adapted to movably suspend and support said cam slide so that said cam slide can move while being guided by the sliding surface of said cam driver as the sliding surface of said cam slide and the sliding surface of said cam driver are brought into contact with each other.

10. The cam apparatus according to claim 1 or 2, wherein said rod has a maximum diameter smaller than a diameter of the through hole, and said coil spring has a maximum diameter smaller than the diameter of the through hole.

11. A cam apparatus comprising:

a cam driver;

a cam slide adapted to move in contact with said cam driver and having a through hole;

cam-slide supporting means having a cam-slide supporting base which movably supports said cam slide, has a front wall portion disposed at a forward position in a moving direction of said cam slide, and has an opening in a backward position opposing said front wall portion in the moving direction of said cam slide; and a returning mechanism for returning said cam slide to an initial position thereof, said returning mechanism including a rod which is passed through the through hole of said cam slide, a rod supporting member which supports said rod slidably in the moving direction of said cam slide and is detachably fitted to said cam slide at one open end of the through hole of said cam slide located on an opening side of said cam-slide supporting base, and a coil spring disposed between said front wall portion and said rod supporting member in such a manner as to surround said rod, so as to resiliently urge said cam slide toward said opening of said cam-slide supporting base, said cam-slide supporting base including both side wall portions arranged on both sides of said cam slide and a suspending and supporting mechanism for movably suspending and supporting said cam slide at said both side wall portions, and said cam-slide supporting means having a drop preventing mechanism for preventing said cam slide from dropping off said cam-slide supporting base, said drop preventing mechanism having drop preventing plates which are removably secured respectively to one of said front wall portion and said both side wall portions on a front wall portion side and to said both side wall portions on the opening side, so as to receive said end portions of said rod when said cam slide drops.

12. The cam apparatus according to claim 11, wherein said drop preventing plates are removably secured respectively to one of a lower surface of said front wall portion and lower surfaces of said both side wall portions on the front wall portion side and to the lower surfaces of said both side wall portions on the opening side by means of bolts.

13. The cam apparatus according to claim 11, wherein said cam slide includes a cam slide body and slide plates which are respectively fitted to both side surfaces of said cam slide body so as to be brought into sliding contact with said side wall portions of said cam-slide supporting base, said suspending and supporting mechanism has suspending members which are removably secured respectively to lower surfaces of said both side wall portions, and distal ends of said suspending members are disposed on lower surfaces of said slide plates of said cam slide, thereby movably suspending said cam slide.

* * * * *